US005724755A

United States Patent [19]

Weagley

[11] Patent Number: 5,724,755

[45] Date of Patent: Mar. 10, 1998

[54] SNOW PUSHER

[76] Inventor: Michael P. Weagley, 7436 E. River Rd., Rush, N.Y. 14543

[21] Appl. No.: 738,862

[22] Filed: Oct. 28, 1996

[51] Int. Cl.[6] ..... E01H 5/04

[52] U.S. Cl. ..... 37/233; 37/231

[58] Field of Search ..... 37/233, 232, 219, 37/454, 449, 231, 266, 267, 281

[56] References Cited

U.S. PATENT DOCUMENTS

| | | | |
|---|---|---|---|
| 3,413,738 | 12/1968 | Goldberg | 37/233 |
| 3,456,456 | 7/1969 | Meyer | 37/233 |
| 3,665,622 | 5/1972 | Lamb | 37/266 X |
| 3,793,752 | 2/1974 | Snyder | 37/233 X |
| 4,570,366 | 2/1986 | Yost | 37/232 |
| 4,597,205 | 7/1986 | Guest | 37/266 X |
| 4,707,936 | 11/1987 | Steinhoff | 37/266 X |
| 4,723,609 | 2/1988 | Curtis | 37/233 X |
| 4,819,349 | 4/1989 | Mensch | 37/233 X |
| 5,121,562 | 6/1992 | Feller | 37/232 X |
| 5,136,795 | 8/1992 | Rosenberg | 37/233 |
| 5,611,157 | 3/1997 | Ferreira | 37/266 X |

*Primary Examiner*—Terry Lee Melius
*Assistant Examiner*—Thomas A. Beach
*Attorney, Agent, or Firm*—Robert J. Bird

[57] ABSTRACT

A snow pusher includes a blade with horizontal and vertical reinforcing channels, a reversible and removable rubber edge fastened to the blade and extending below its bottom edge, and a side plate extending forward from each end of the blade. Each side plate includes a removable wear shoe with inclined ramps for sliding contact on the ground surface. Upper and lower rows of posts extend rearward from the blade to form a slot for insertion of a front end loader bucket. Connection is secured by a releasable chain.

4 Claims, 3 Drawing Sheets

SNOW PUSHER

FIELD OF THE INVENTION

This invention is a snow pusher of the kind used for large areas, such as parking lots and airport runways.

BACKGROUND OF THE INVENTION

Snow pushers of various configurations are presently known. They are typically characterized by one or more of the following: a relatively complex mounting arrangement, a steel blade as the snow scraper, a relatively light construction backed with ribs and angles.

Objects of this invention are to provide a snow pusher with an adjustable replaceable rubber squeegee blade, replaceable wear shoes for sliding contact on the ground surface, quick and simple mounting and dismounting, and improved strength of construction.

SUMMARY OF THE INVENTION

A snow pusher according to this invention includes a transverse blade with horizontal and vertical reinforcing channels on its back, a reversible and removable rubber edge fastened to the blade and extending below its bottom edge, and a vertical side plate extending forward from each end of the blade. Each side plate includes a removable wear shoe with front and back inclined ramps for sliding contact on the ground surface. Upper and lower horizontal rows of posts extend rearward from the blade to form a slot for insertion of a front end loader bucket to move the snow pusher. Connection is secured simply by a releasable chain.

DRAWING

DESCRIPTION OF PREFERRED EMBODIMENT

Figure 1:
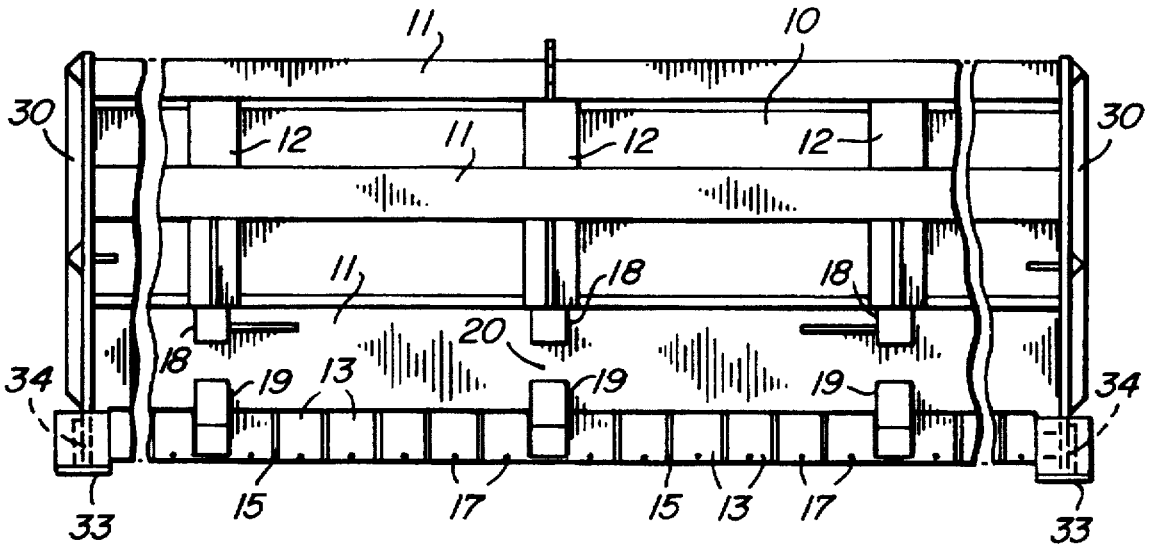
FIG. 1 is a rear elevation view of the snow pusher of this invention.

Referring now to the drawing, my snow pusher includes an upstanding steel blade 10, and a vertical side plate 30 at each end of the blade 10 and extending forward from it.

The back side of the blade 10 includes horizontal reinforcing channels 11 and 11' welded across the width of the blade 10, vertical reinforcing channels 12 welded between the horizontal channels 11 and 11', and a backing flat stock member 13 behind the bottom edge 14 of the blade 10 and extending the width of the blade 10. The backing member 13 is stiffened by gussets 15 spaced twelve inches on centers along its length.

A resilient rubber edge 16 is mounted along the bottom of the blade 10, extending approximately two inches below the steel edge 14 of the blade 10. The rubber edge 16 is one and one-half inches thick and ten inches high. it includes bolt hole for removable mounting to the blade 10 and to the backing member 13 by bolts 17. Mounting of the rubber edge 16 is adjustable and reversible to accommodate for wear.

The blade 10 includes an upper horizontal row of three posts 18, and a lower horizontal row of three posts 19, extending out from the lowermost horizontal channel 11' on the back of the blade. The parallel upper and lower rows of posts form a horizontal receptacle or slot 20 between them. A bucket 25 of a front end loader machine (FIG. 3) fits within the slot 20.

The bucket 25 is movable into and out of the slot 20, to respectively engage the blade 10 for operation of the snow pusher, and to disengage the blade 10.

Figure 2:
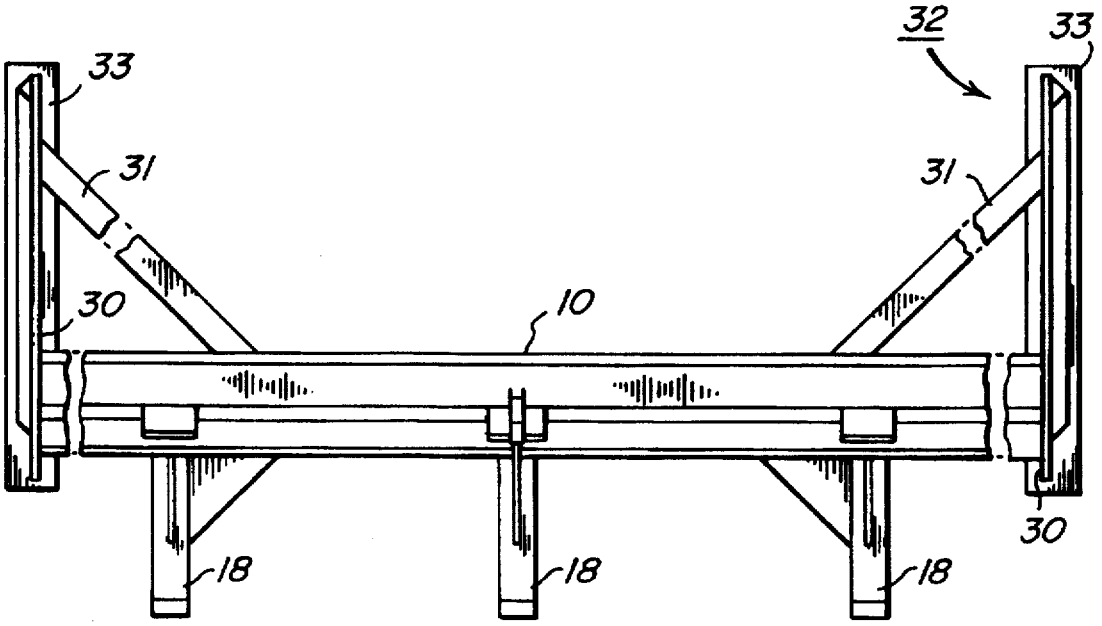
FIG. 2 is a top view of the snow pusher of FIG. 1.
Figure 3:
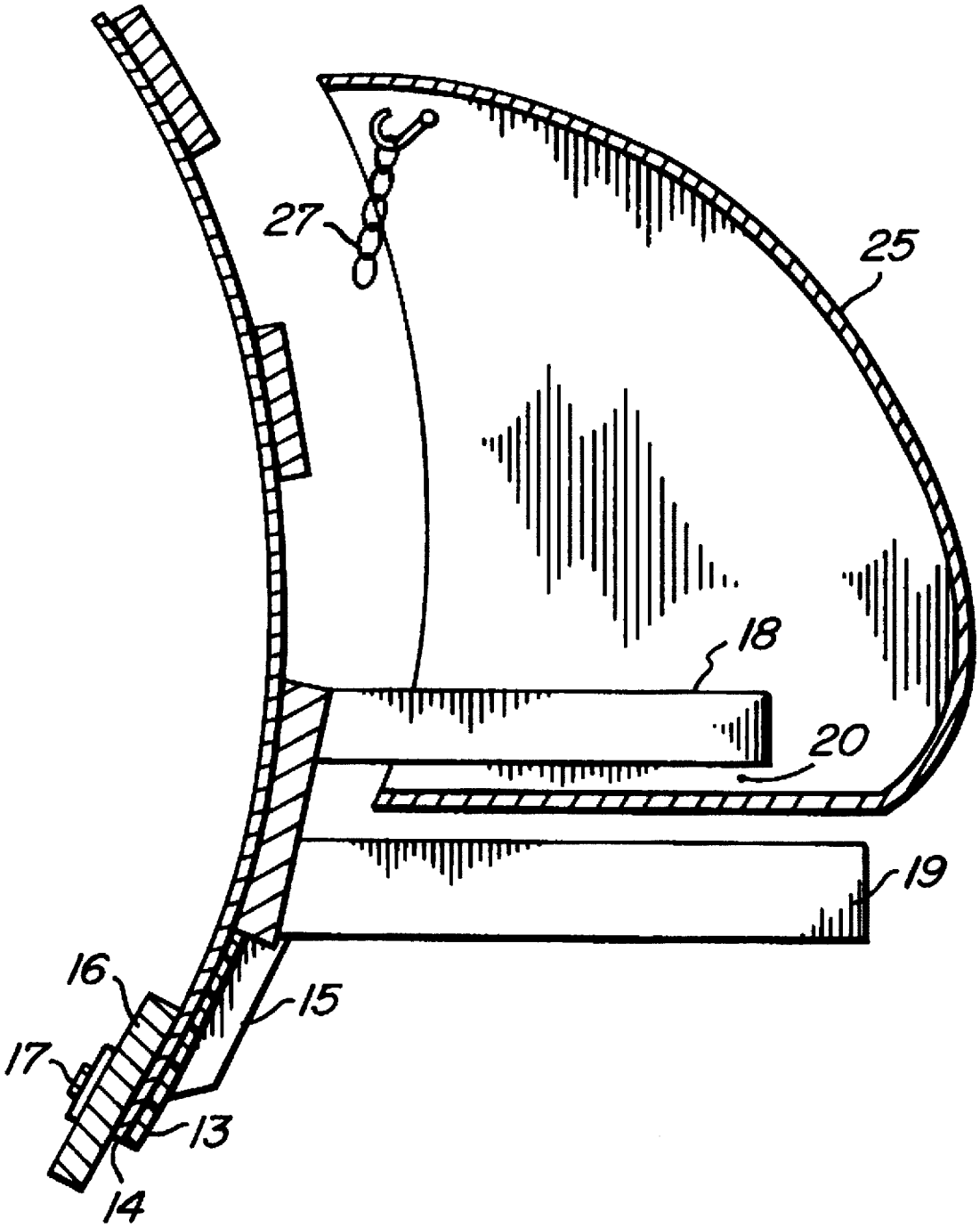
FIG. 3 is a sectional left side view of the snow pusher of FIG. 1.
Figure 4:
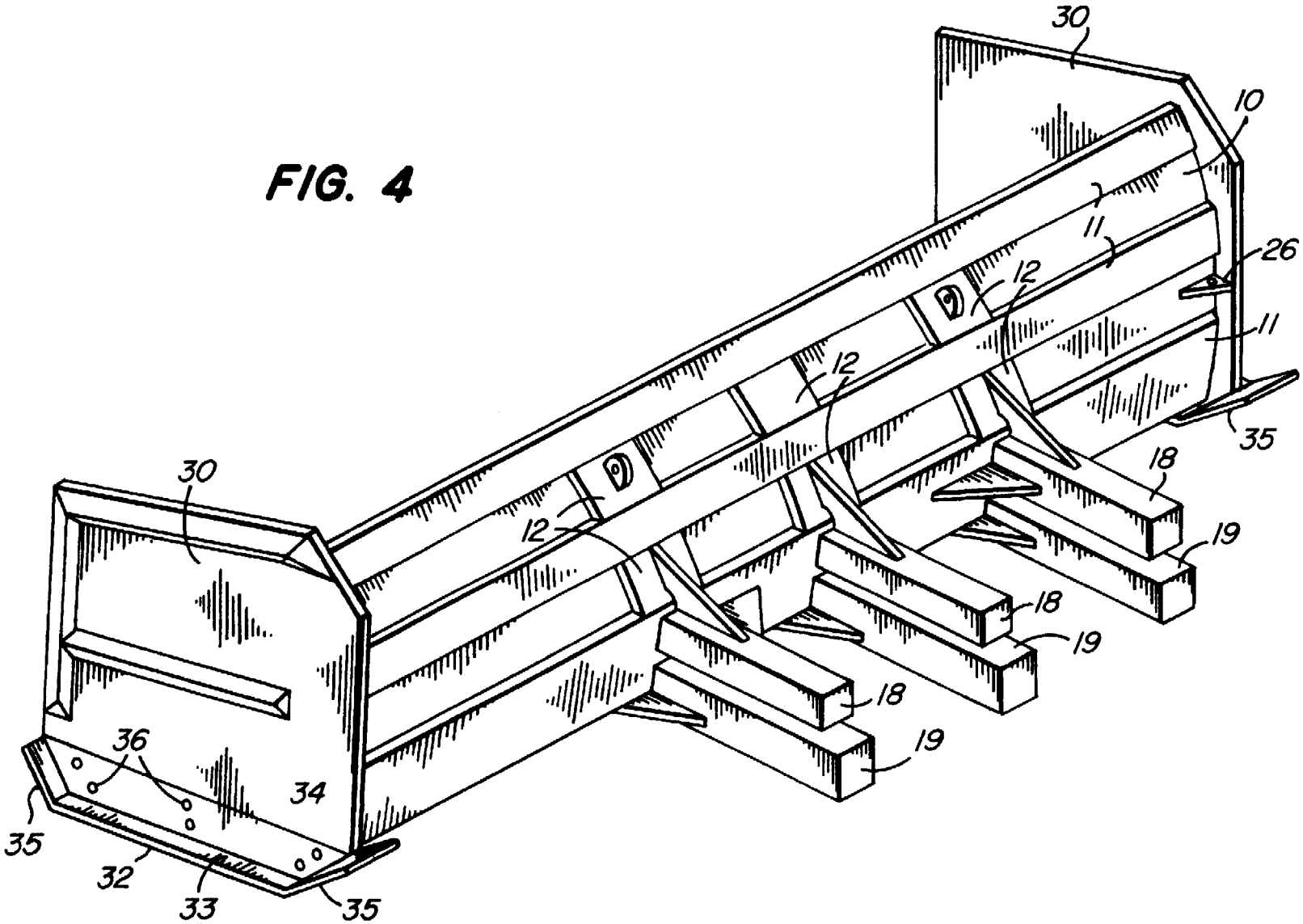
FIG. 4 is a pictorial view of the snow pusher, from upper left rear.

The posts 18, 19 are rectangular in cross section (FIG. 2). The upper posts 18 are of width W and height H; lower posts 19 are the same width W but of height H', greater than H. The lower posts 19 are also longer than the upper posts 18 (FIG. 3).

A vertical side plate 30 extends forward from each end of the blade 10. Side plates 30 are placed to the front of the blade 10 by braces 31 (FIG. 2) Each side plate includes a removable wear shoe 32 on its bottom for sliding contact with the ground surface. The wear shoes 32 each include a bottom runner 33 and a vertical web 34. The runners 33 are of AR514T 1 high carbon alloy steel, one inch thick and six inches wide, with 45° ramp surfaces 35 at front and back to permit easy riding over surface irregularities and the like. The wear shoe 32, by means of their vertical webs 34, are removably fastened to their respective vertical side plates 30 by bolts 36.

The wear shoes 32 are the ground surface contact members. There is a clearance of about two inches between ground level and the steel edge 14. The rubber edge 16 acts as a "squeegee" over the ground surface, but does not bear the weight of the apparatus.

With a front end loader bucket 25 in place in the slot 20 to operate the snow pusher, chains 27 are connected to binder plates 26 on opposite ends of the blade 10 and to an upper part of the bucket 25 to secure the blade 10 to the bucket 25. The chains 27 are easily connected and disconnected to and from the blade 10 and bucket 25.

The reinforcing channel members 11, 11', 12 are welded along their entire lengths to the blade 10. Welded straight channels are inherently stronger and not prone to failure by buckling, as compared to typical prior art vertical curved ribs cut from steel plate.

The posts 18, 19, and the slot 20 which they provide allows for quick and easy installation and removal of the snow pusher on any bucket machine. Once the bucket 25 is positioned within the slot 20, hookup of the chains 27 is accomplished in less than five minutes.

The wear shoes 32 may be thought of as the "sacrificial" members of the snow pusher. They are bolt mounted for easy replacement when necessary.

The rubber edge 16 is flexible enough to glide over many ground surface irregularities without gouging asphalt, concrete, or tar-gravel surfaces. It also rides easily over grates, manhole covers, and other such potential hazards, permitting higher speed and damage-free snow removal.

In this description, "ground surface" is intended as a convenient term to include any surface such as road, parking lot, runway, or the like where this snow pusher is to be used. Similarly, "rubber" is intended as a convenient term to include the entire range of rubbers or elastomers suitable for the use described herein.

The foregoing description of a preferred embodiment of this invention, including any dimensions, angles, or proportions, is intended as illustrative. The concept and scope of the invention are limited only by the following claims and equivalents thereof.

What is claimed is:

1. A snow pusher, including:

an upstanding transverse blade with a front, back, and bottom, said blade including a plurality of horizontal and vertical reinforcing channels on the back thereof;

a reversible rubber edge removably fastened to said blade and extending along and below the bottom thereof;

a vertical side plate extending forward from each end of said blade;

a wear shoe removably mounted on each side plate for sliding contact on a ground surface, said shoe having inclined front and rear ramp surfaces;

an upper horizontal row of posts, and a parallel lower row of larger posts, extending rearward from said blade, said rows defining an open slot for removable insertion therein of driving means to move said snow pusher; and means to releasably secure said blade to said driving means.

2. A snow pusher, including:

an upstanding transverse blade with a front, back, and bottom, said blade including a plurality of horizontal and vertical reinforcing channels on the back thereof, and a horizontal backing member with a plurality of vertical gussets mounted on said blade along and behind the bottom thereof;

a reversible rubber edge removably fastened to said backing member and to said blade, and extending along and below the bottom thereof;

a vertical side plate extending forward from each end of said blade and braced to the front thereof;

a wear shoe removably mounted on each side plate for sliding contact on a ground surface below said rubber edge, said shoe having inclined front and rear ramp surfaces;

an upper horizontal row of posts, and a corresponding lower horizontal row of larger posts extending rearward from the lowermost of said horizontal channels, said upper and lower rows defining an open slot for removable insertion therein of driving means to move said snow pusher; and releasable means to connect the upper portion of said blade to said driving means to maintain the upstanding attitude of said blade.

3. A snow pusher as defined in claim 1, said upper posts having a height dimension H and said lower posts having a height dimension H', greater than H.

4. A snow pusher as defined in claim 2, said upper posts having a height dimension H and said lower posts having a height dimension H', greater than H.

* * * * *